United States Patent [19]

Long

[11] Patent Number: 4,844,332

[45] Date of Patent: Jul. 4, 1989

[54] MAILBOX

[76] Inventor: Timothy P. Long, 6 Meadowlark La., North Oaks, Minn. 55110

[21] Appl. No.: 167,962

[22] Filed: Mar. 14, 1988

[51] Int. Cl.[4] ..... B65D 91/00

[52] U.S. Cl. ..... 232/17; 232/43.1

[58] Field of Search ..... 232/17, 30, 31, 32, 232/38, 43.1, 43.2

[56] References Cited

U.S. PATENT DOCUMENTS

| | | | |
|---|---|---|---|
| 3,735,919 | 5/1973 | Morgan | 232/17 |
| 3,758,027 | 9/1973 | Morgan | 232/17 |
| 3,880,344 | 4/1975 | Earle | 232/17 |
| 4,186,869 | 2/1980 | Brown | 232/17 |
| 4,361,271 | 11/1982 | Hester et al. | 232/17 |
| 4,650,113 | 3/1987 | Hunt | 232/30 X |
| 4,724,999 | 2/1988 | Fitzgerald et al. | 232/17 |

*Primary Examiner*—Robert W. Gibson, Jr.
*Attorney, Agent, or Firm*—Hugh D. Jaeger

[57] ABSTRACT

Mailbox for receiving and securing storage of mail, parcels and newspapers for short or extended periods of time. Mail or newspapers deposited in an upper structure of the mailbox descend through an intermediate structure to deposit in a lockable pullout drawer for daily removal through the front or rear of the mailbox, or further descent through a positionable collapsible bottom of the pullout drawer and into a base storage structure for storage on a long term basis. Contents in the mailbox drawer can be accessed from the drawer front or by a rear access door which also accesses mail in the base structure. The long term storage compartment can be accessed through the rear access door.

9 Claims, 5 Drawing Sheets

MAILBOX

BACKGROUND OF THE INVENTION

1. Field of the Invention

The present invention pertains to a mailbox and, more importantly, relates to a secured mailbox for short term or long term storage of mail, newspapers or parcels.

2. Description of the Prior Art

Prior art mailbox devices have generally provided limited internal storage capacity such that when a mailbox was full, mail could not be delivered, even by an ingenious postman, thus depriving a postal patron of his or her mail until such a time the mail was emptied by the postal patron to provide room for subsequent postal or newspaper delivery. Often, prior art devices did not provide for security of the mailbox contents, leaving the contained contents accessible by certain third parties who could be of questionable character. Prior art devices generally provide for contents accessing through the front of the mailbox structure, thus causing the postal patron to step onto a busy thorough fare to obtain mail from the mailbox.

The present invention overcomes the disadvantages of the prior art by providing a mailbox with both long term and short term storage capabilities, allowing for mail to be stored by presetting of a plurality of positionable collapsible bottom members in the upper and intermediate structure of the mailbox, or members thereof, through which mail can pass either to a lockable pullout drawer, accessible from the front or rear of the mailbox, or to a long term secured storage base structure which is accessible from the rear of the mailbox.

The present invention also provides a means to send out-going mail via a positionable plate to the upper mailbox.

SUMMARY OF THE INVENTION

The general purpose of the present invention is to provide a secured mailbox with both long term and short term capabilities where a larger interior portion of the mailbox is available when long term storage is desired.

According to one embodiment of the present invention, there is provided a mailbox, including a positionable collapsible bottom member for out-going mail or receiving of mail or newspapers, a base structure for long term mail storage and an intermediate structure including a pullout drawer with a positionable collapsible bottom and a rear access door.

One significant aspect and feature of the present invention is a mailbox which provides for short term storage either in an upper loading structure or in a secured intermediate structure.

Another significant aspect and feature of the present invention is a mailbox which allows storage of a quantity of mail, newspapers, or parcels over an extended period of time.

Another significant aspect and feature of the present invention is a mailbox which includes a rollout mail containment drawer which is accessible from both the front and from the back of the mailbox.

A further significant aspect and feature of the present invention is a rollout drawer including a positionable collapsible bottom which positions for short or long term mail storage.

Yet another significant aspect and feature of the present invention is a positionable collapsible member in the upper structure to allow the free fall of mail into a rollout drawer.

Having thus described the embodiments of the present invention, it is a principal object hereof to provide a secured mailbox for short term and long term storage of mail, newspapers, and parcels.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
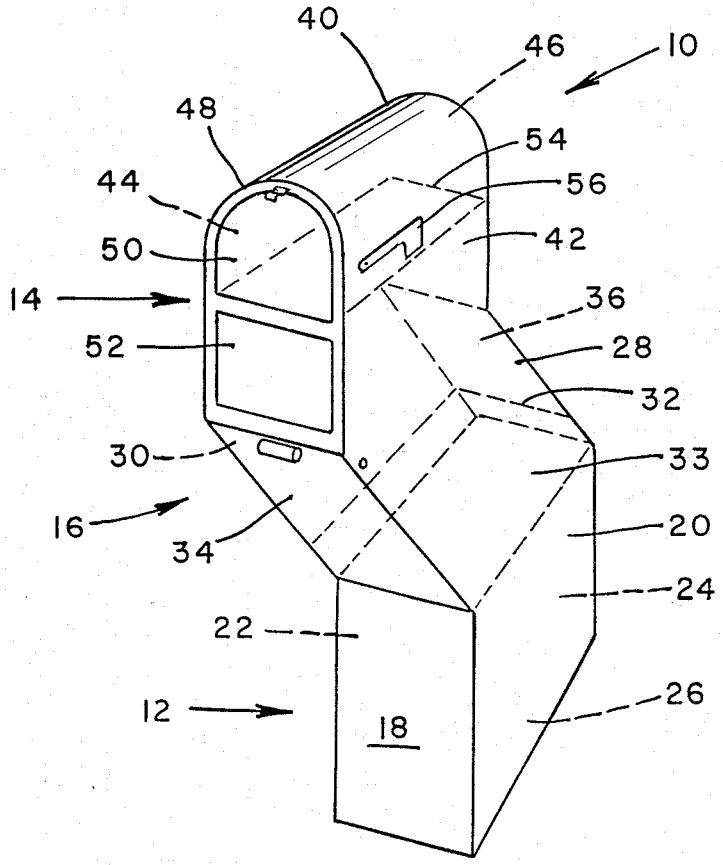
FIG. 1 illustrates a perspective view of the mailbox, the present invention.

FIG. 1 illustrates a mailbox 10 for the storage of mail, newspapers, or parcels which includes areas of storage for daily use and for extended storage use. The mailbox 10 includes a base structure 12, a loading structure 14 and an intermediate structure 16 between the base structure 12 and the loading structure 14. The base structure 12 includes a front 18, sides 20 and 22, a back 24, and a bottom 26. The intermediate structure 16 includes parallelogram shaped sides 28 and 30 connecting to sides 20 and 22, respectively, of the base structure 12. A lockable drawer 32 for daily access of the mailbox contents, positions in and is part of the intermediate structure 16 and includes and attached front panel 34 that mates with the front canted portion of the intermediate structure 16 to seal and close the intermediate structure. The lockable drawer 32 also includes a positionable collapsible bottom 33. A hinged lockable rear access door 36, part of the intermediate structure 16, locates in the rear portion of the intermediate housing 16 for access to contents contained in the lockable drawer 32 or long term stored items in the base structure 12. The loading structure 14 includes a rounded top 40, sides 42 and 44 extending from the top 40 and connecting to parallelogram sides 28 and 30, respectively, of the intermediate structure 16, a back panel 46 extending between the rear portion of sides 42 and 44 and the rounded top 40, and a front panel 48 extending between the forward portion of sides 42, 44 and the rounded top 40. The front panel 48 includes a pivoted and latched rounded top door 50 and another pivoted bottom door 52 below the pivoted top door 50. A positionable collapsible member 54 is located between sides 42 and 44 in the loading structure. A flag 56 is located on the side 42 of the loading structure.

Figure 2:
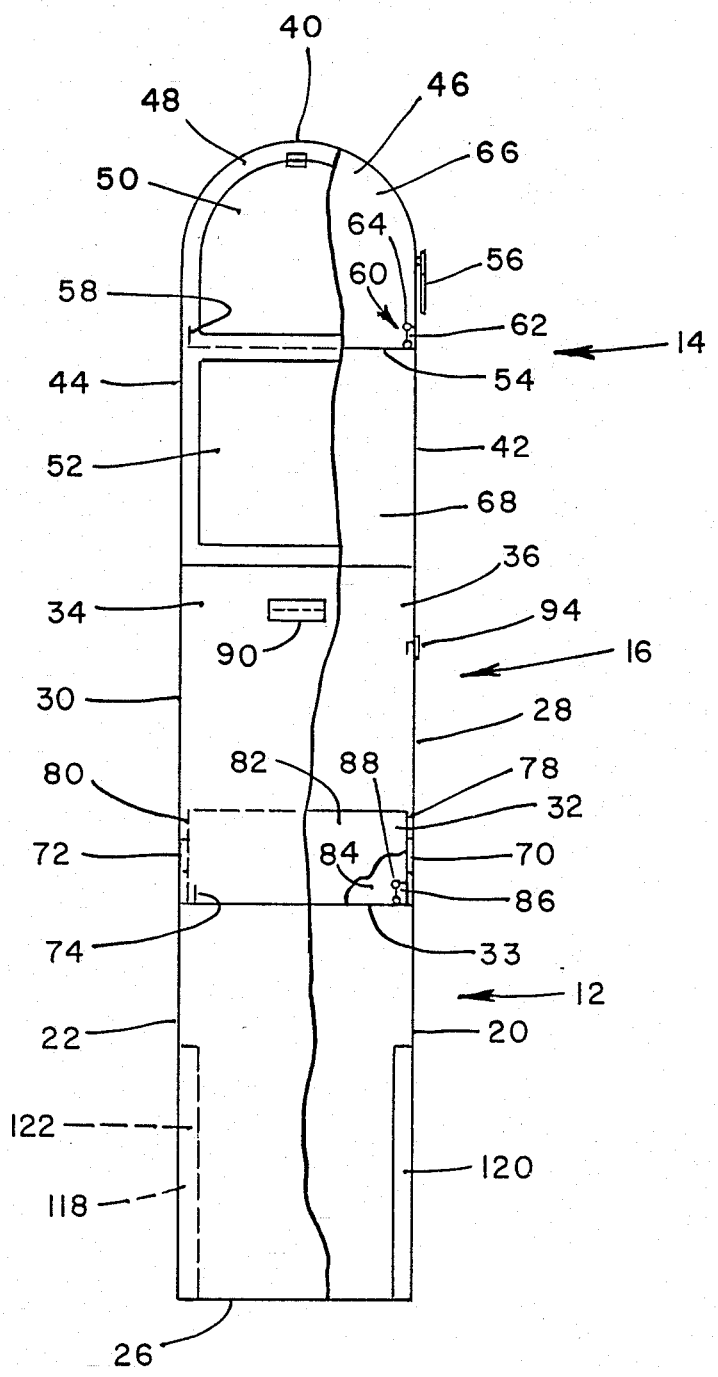
FIG. 2 illustrates a front view in cutaway of the mailbox.

FIG. 2 illustrates a front view in cutaway of the mailbox 10 illustrating placement of the positionable collapsible member 54 in the loading structure 14 and of the positionable collapsible bottom 33 of the lockable drawer 32 in the intermediate structure 16. All numerals correspond to those elements previously described. The upper positionable collapsible member 54 pivots about a hinge 58 mounted on side 44. A securing device 60 is illustrated as an angled hook 62 secured to the collapsible member 54 and fitting into an eyelet 64 in side 42 to secure the collapsible member 54 in a horizontal position, but may be any other securing device which will readily allow the collapsible member 54 to be secured in a horizontal position. When in the unsecured position, the collapsible member 54 is allowed to free fall to a vertical position. The collapsible member 54 is secured in the horizontal position for placement of outgoing mail in the upper loading structure area 66. The collapsible member 54 is left in an unsecured vertical position, as illustrated in FIG. 4, for daily incoming mail and allows mail placed in the upper loading structure area 66 to be gravitationally moved downwardly through the lower loading structure area 68, through the intermediate structure 16 into the lockable drawer 32.

Lockable drawer 32 mounts on slide tracks 70 and 72 secured to parallelogram sides 28 and 30. The positionable collapsible bottom 33 pivots about a hinge 74 in the lockable drawer 32. Lockable drawer 32 is illustrated in FIG. 5 and includes a bottom 76, opposing parallelogram sides 78 and 80, a canted back 82 and hinge 74 between parallelogram side 80 and the positionable collapsible bottom 33. The positionable collapsible bottom 33 is secured in a fashion similar to the securement of the collapsible member 54 in the loading structure 14. A securing device 84, similar to securing device 60, is illustrated as an angled hook 86 secured to the collapsible bottom 33 and fitting into an eyelet 88 in the parallelogram side 78 to secure the collapsible bottom 33 in a horizontal position, but may be any other securing device which will readily allow the bottom to be secured in a horizontal position. The collapsible bottom 33 is secured in the horizontal position to receive mail, newspapers or parcels deposited through the lower loading structure area 68, or through the upper loading structure area 66 when the collapsible member 54 is in the vertical position. The positionable collapsible bottom 33 of the lockable drawer 32 is left unsecured and in the vertical position so that mail, newspapers or parcels can descend the full length of the mailbox 10 into the base structure for long term quantity storage, such as when the mailbox is not emptied for a period of time. FIG. 4 illustrates the collapsible positionable bottom 33 and positionable collapsible member 54 in their unsecured vertical position allowing for full free fall of contents placed into the mailbox 10.

Figure 3:
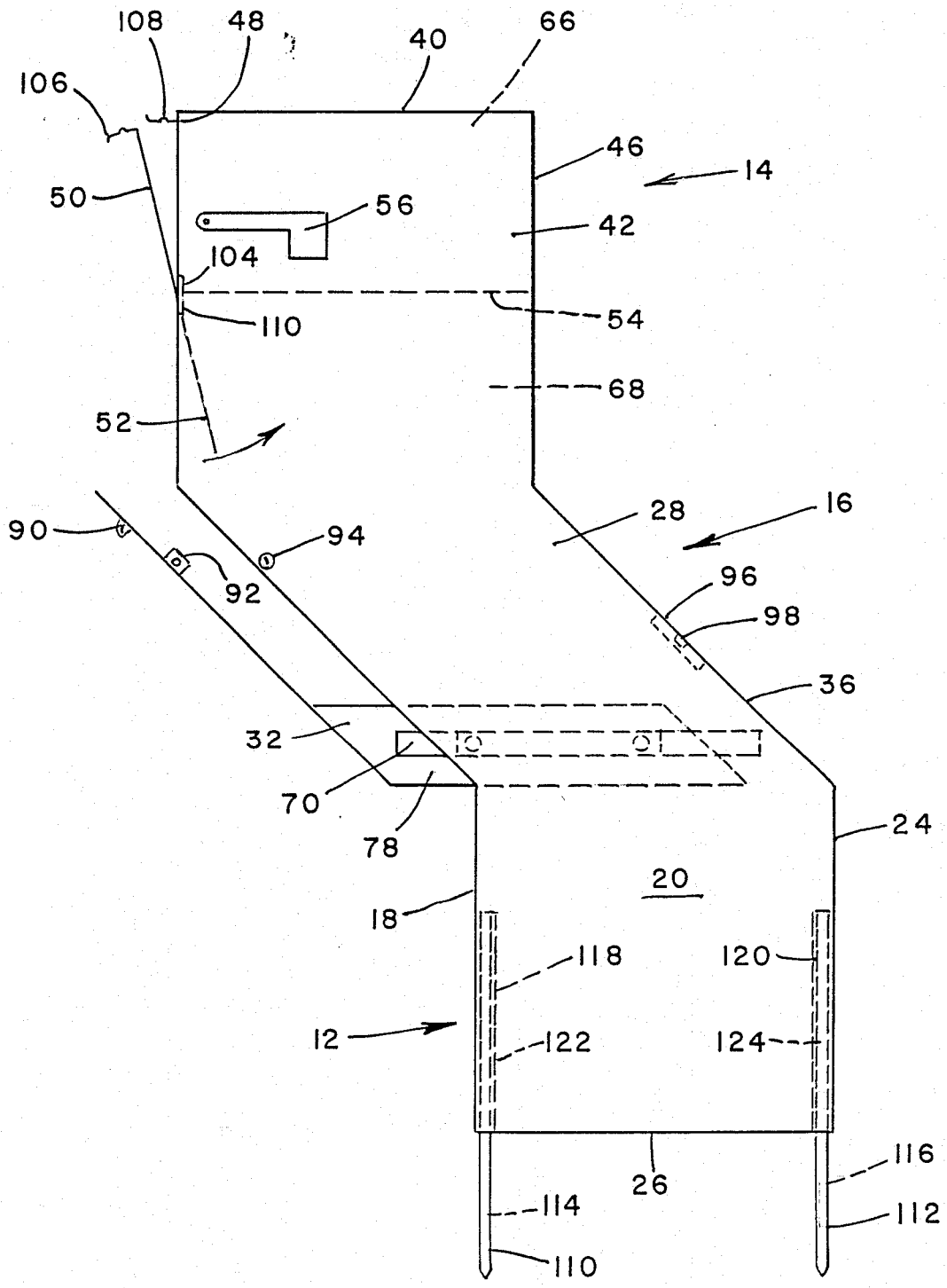
FIG. 3 ilustrates a side view of the mailbox.

FIG. 3 illustrates a side view of the mailbox 10 illustrating the drawer 32 partially extended from the intermediate structure where all numerals correspond to those elements previously described. The drawer front panel 34 includes a handle for opening the lockable drawer 32 with the drawer front panel 34 and a lock catch 92. The lock catch 92 engages a lock 94 in parallelogram side 28 of the intermediate structure 16 to provide for security of the lockable drawer 32 in the mailbox 10. The rear access door 36, also illustrated in FIG. 4, includes a handle 96 and a lock 98. The lock 98 engages a catch 100 in parallelogram side 28 of the intermediate structure 16. The rear access door pivots about a hinge illustrated in FIG. 4. Top door 50 pivots outwardly from a hinge 104 to receive mail into the upper loading structure area 66 and includes a latch 106 which engages catch 108 on the front panel 48. Bottom door 52 pivots inwardly into the lower loading structure area 68 to receive newspapers, parcels or mail into the lower loading structure area 68. Securing stakes 110–116 secure angled capturing members 118–124 into the ground to provide for securement and mounting of the mailbox 10 to the ground.

Figure 4:
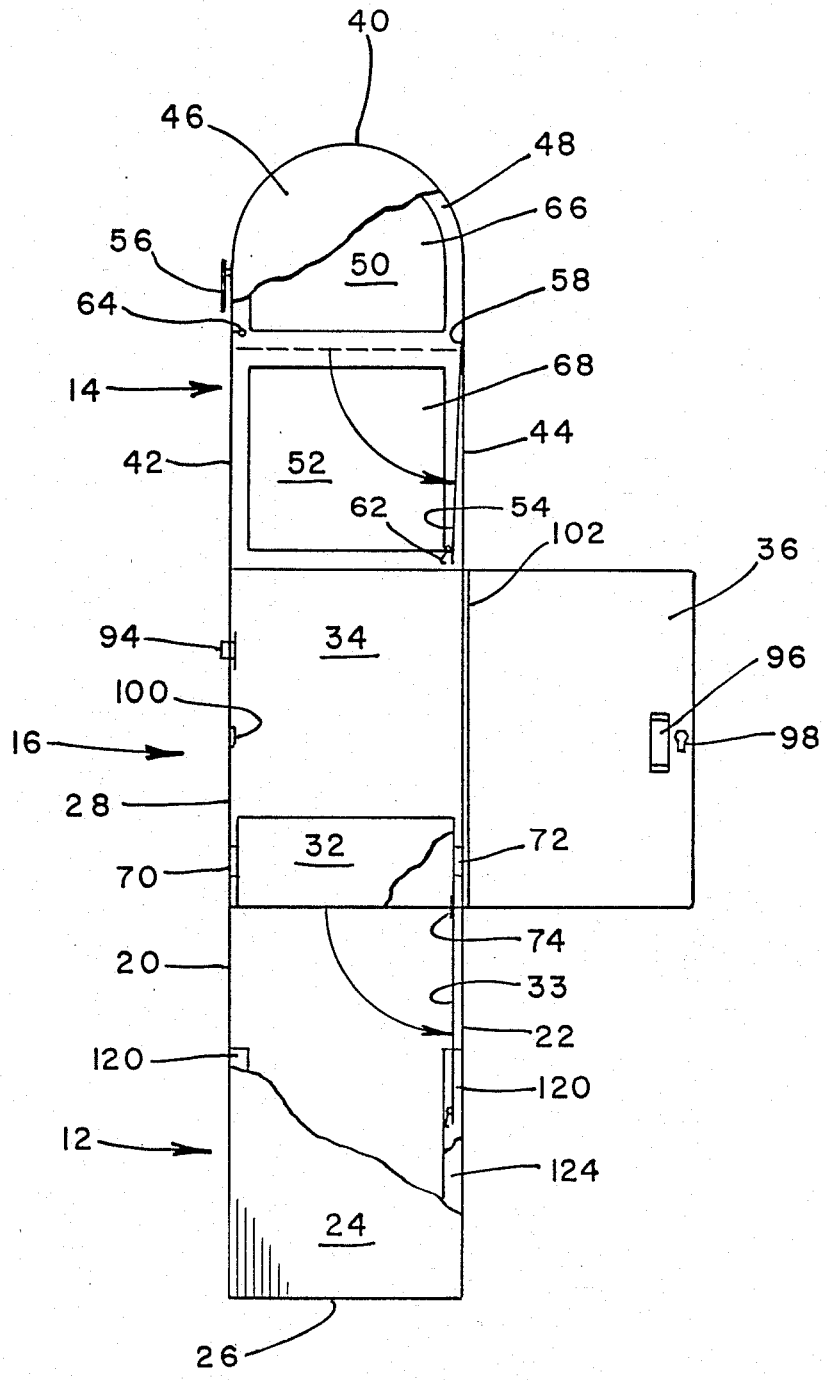
FIG. 4 illustrates a rear view of the mailbox in cutaway.
Figure 5:
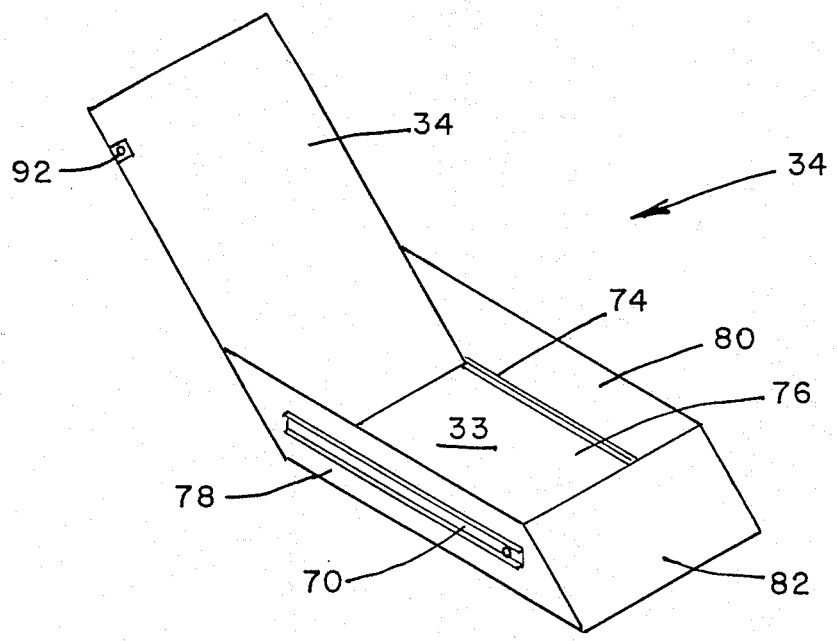
FIG. 5 illustrates a perspective view of the drawer.

FIG. 4 illustrates a rear view of the mailbox 10 illustrating the positionable collapsible bottom 33 and positionable collapsible member 54 in the unsecured horizontal position, and rear access door 36 is illustrated in the open position for accessing of the base structure 12 as illustrated. The rear access door also opens for the accessing of the contents of the lockable drawer 32 should the positionable collapsible bottom be in the horizontal position as in FIG. 2.

FIG. 5 illustrates a perspective view of the lockable drawer 32 where all numerals correspond to those elements previously described.

MODE OF OPERATION

FIGS. 2 and 4 best illustrated the mode of operation. Normal style mailbox operation occurs when the collapsible member 54 in the loading structure 14 is secured in the horizontal position. Mail is loaded by the post person into the top door 50 to rest within the upper loading structure area 66, and can be retrieved by the postal patron through the same top door 50 or newspapers or parcels can be loaded into the bottom door 52 for secured deposit by free fall through the interior of the intermediate structure 16 and into an appropriate underlying member. Outgoing mail may also be placed in the upper loading structure 66 for retrieval by a postal employee. Secured mail delivery and acceptance occurs when members of the securing device 60 disengage to allow the collapsible member 54 to assume a vertical position as illustrated in FIG. 4. Deposited mail inserted through the top door 50 free falls past the vertically positioned collapsible member 54 and papers deposited through the bottom door 52 free fall through the intermediate structure 16 to deposit within the short term lockable drawer 32 of the intermediate structure 16. The contents are then accessed from the front by actuating the drawer front panel 34 by pulling on the handle 90 to move the drawer outwardly or by opening the rear access door 36 with the handle 96 to gain entry of the contents deposited in the lockable drawer 32. Long term storage in the bottom structure is accomplished by positioning the positionable collapsible member 54 vertically as described and by disengaging the members of the securing device 84 to allow the positionable collapsible door 33 of the lockable drawer 32 to assume a vertical position as illustrated in FIG. 4. Mail descending through the intermediate structure 16 travels vertically by force of gravity through the lockable drawer 32 with the downwardly extended collapsible bottom 33, and is thus deposited in the base structure 12 for long term storage. Access is provided to the base structure 12 through the rear access door 36. Mounting of the mailbox 10 to the earth is provided by driving the securing stakes 110–116 into the ground through the angled capturing members 118–124.

Various modifications can be made to the present invention without departing from the apparent scope hereof.

I claim:

1. A mailbox for short term and long term storage of mail, newspapers, parcels or other materials comprising:

a. a loading structure, said loading structure including a rounded top, two sides extending downwardly from said rounded top to connect with an intermediate structure including two vertically oriented sides connecting with said sides of said loading structure, an access door and a front panel with an attached drawer, a rear panel, a latch and a catch and a flag; a base structure, said base structure including a bottom, a front, a back, sides from said bottom, said sides extending to connect with said sides of said intermediate structure; and, said intermediate structure disposed therebetween, b. an upper and lower loading door on the front panel of said loading structure, said loading structure including an upper area and a lower area;

c. a positionable collapsible member in said loading structure;

d. a securing means for positioning said positionable collapsible member in a horizontal position;

e. a drawer within said intermediate structure, said drawer including a lock and handle;

f. a positionable collapsible bottom in said lockable drawer;

g. a securing means for positioning said positionable bottom of said drawer;

h. a hinged rear across door secured to the rear portion of said intermediate structure, said rear access door including a lock and a handle;

i. said base structure which includes angled capturing members; and, j. securing stakes securing through said angled capturing members into the earth.

2. Mailbox of claim 1 wherein mail, newspapers, or parcels loaded into said loading structure gravitationally descend from said loading structure through an intermediate structure and into said drawer of said intermediate structure for short term storage.

3. Mailbox of claim 1 wherein mail, newspapers or parcels loaded into said loading structure gravitationally descend from said loading structure through an intermediate structure, through said drawer with said positionable collapsible bottom vertically positioned and into said base structure for long term storage.

4. Mailbox of claim 1 wherein said drawer is accessible by sliding said drawer outwardly.

5. Mailbox of claim 1 wherein said drawer is accessible by opening said rear access door.

6. Mailbox of claim 1 wherein said rear access door is opened to access long term stored contents in said base structure.

7. Mailbox of claim 1 wherein said loading structure positionable collapsible member positions horizontally or vertically.

8. Mailbox of claim 1 wherein said positionable collapsible drawer bottom member positions horizontally or vertically.

9. A mailbox for short term and long term storage of mail, newspapers, parcels or other materials comprising:

a. a loading structure, said loading structure including a rounded top, two sides extending downwardly from said rounded top to connect with an intermediate structure including two vertically oriented sides connecting with said sides of said loading structure, an access door and a front panel with an attached drawer, a rear panel, a latch, a catch and a flag; a base structure, said base structure including a bottom, a front, a back, sides from said bottom, said sides extending to connect with said sides of said intermediate structure; and, said intermediate structure disposed therebetween;

b. an upper and lower loading door on the front panel of said loading structure, said loading structure including an upper area and a lower area;

c. a positionable collapsible member in said loading structure;

d. a securing means for positioning said positionable collapsible member in a horizontal position; and, e. a hinged rear access door secured to the rear portion of said intermediate structure, said rear access door including a lock and a handle.

* * * * *